US011273534B2

(12) United States Patent
Pekija

(10) Patent No.: US 11,273,534 B2
(45) Date of Patent: Mar. 15, 2022

(54) GRINDING WHEEL AND GRINDING APPARATUS

(71) Applicant: DISCO CORPORATION, Tokyo (JP)

(72) Inventor: Dejan Pekija, Munich (DE)

(73) Assignee: DISCO CORPORATION, Tokyo (JP)

( * ) Notice: Subject to any disclaimer, the term of this patent is extended or adjusted under 35 U.S.C. 154(b) by 860 days.

(21) Appl. No.: 16/124,354

(22) Filed: Sep. 7, 2018

(65) Prior Publication Data

US 2019/0076990 A1 Mar. 14, 2019

(30) Foreign Application Priority Data

Sep. 13, 2017 (JP) ..... JP2017-175310

(51) Int. Cl.
*B24B 7/04* (2006.01)
*B24B 7/22* (2006.01)
*B24D 7/06* (2006.01)

(52) U.S. Cl.
CPC ..... *B24D 7/066* (2013.01); *B24B 7/04* (2013.01); *B24B 7/228* (2013.01)

(58) Field of Classification Search
CPC ... B24B 27/0015; B24B 41/068; B24B 47/20; B24B 7/04; B24B 7/228; B24D 7/06; B24D 7/066; B24D 18/00; B24D 5/123
USPC ..... 451/529, 550, 548
See application file for complete search history.

(56) References Cited

U.S. PATENT DOCUMENTS

RE17,853 E * 11/1930 McGovern ..... B24D 7/02 451/551
2,980,098 A * 4/1961 Wayland ..... B24D 7/10 125/3
4,918,872 A * 4/1990 Sato ..... B24B 37/26 451/450
6,196,911 B1 * 3/2001 Preston ..... B24D 18/00 451/548
6,672,943 B2 * 1/2004 Vogtmann ..... B24B 7/228 451/259
2003/0089364 A1 * 5/2003 Kim ..... B28D 1/041 125/39
2014/0273773 A1 * 9/2014 Chou ..... B24B 53/017 451/443
2016/0256982 A1 * 9/2016 Mejean ..... B24D 7/06

FOREIGN PATENT DOCUMENTS

CN 101659033 A * 3/2010 ..... B24B 37/04
GB 953855 * 2/1963 ..... B23D 61/021
JP 200196467 A 4/2001

* cited by examiner

*Primary Examiner* — Joseph J Hail
*Assistant Examiner* — Arman Milanian
(74) *Attorney, Agent, or Firm* — Greer Burns & Crain Ltd.

(57) ABSTRACT

A grinding wheel includes a plurality of grinding stone groups arranged in an annular array, each of the grinding stone groups including at least three grinding stone segments having different thicknesses which include a smallest thickness, an intermediate thickness, and a largest thickness. The grinding stone segments in each of the grinding stone groups are successively arranged in the order of the grinding stone segment having the smallest thickness, the grinding stone segment having the intermediate thickness, and the grinding stone segment having the largest thickness, with uniform gaps left therebetween. The grinding stone segments in the grinding stone groups have respective radially inner edges aligned with each other in an annular shape.

2 Claims, 4 Drawing Sheets

GRINDING WHEEL AND GRINDING APPARATUS

BACKGROUND OF THE INVENTION

Field of the Invention

The present invention relates to a grinding wheel and a grinding apparatus.

Description of the Related Art

Grinding apparatus for grinding wafers include a grinding wheel having an annular array of grinding stone segments. The grinding wheel is rotated to grind a surface of a wafer with the grinding stone segments. Heretofore, there has been proposed a grinding wheel having grinding stones for grinding with high accuracy a central area of a wafer uniformly without undue uneven wear (see, for example, Japanese Patent Laid-open No. 2001-096467).

The grinding wheel disclosed in Japanese Patent Laid-open No. 2001-096467 has an annular array of grinding stones mounted on an end face thereof. The grinding stones include closer grinding stones that are disposed closer to the center of the grinding wheel and remoter grinding stones that are disposed remoter from the center of the grinding wheel. The closer grinding stones and the remoter grinding stones are disposed alternately with each other and in point symmetry across the center of the grinding wheel. The grinding stones thus arranged prevent themselves from contacting the center of rotation of the wafer at all times, grind the surface of the wafer uniformly in its entirety, and allow the grinding wheel to rotate stably for grinding the wafer to a nicety.

SUMMARY OF THE INVENTION

With the grinding wheel disclosed in the above publication, the closer grinding stones and the remoter grinding stones grind different areas of the surface of the wafer. Consequently, the grinding stones may possibly fail to exhibit a sufficient ability to bite into the surface being ground of the wafer. Particularly, the problem of an insufficient biting ability is liable to occur when those grinding stones are used to grind wafers made of a hard material such as SiC or sapphire.

It is therefore an object of the present invention to provide a grinding wheel and a grinding apparatus which have an improved ability to bite into the surface being ground of a wafer.

In accordance with an aspect of the present invention, there is provided a grinding wheel including a plurality of grinding stone groups arranged in an annular array, each of the grinding stone groups including at least three grinding stone segments having different thicknesses, which include a smallest thickness, an intermediate thickness, and a largest thickness. The grinding stone segments in each of the grinding stone groups are successively arranged in the order of the grinding stone segment having the smallest thickness, the grinding stone segment having the intermediate thickness, and the grinding stone segment having the largest thickness, with uniform gaps left therebetween, and the grinding stone segments in the grinding stone groups have respective radially inner edges aligned with each other in an annular shape.

In accordance with another aspect of the present invention, there is provided a grinding apparatus including a holding table having a holding surface for holding a wafer thereon, a holding table rotating unit configured to rotate the holding table in a predetermined direction, a grinding unit having a spindle and a grinding wheel mounted on a distal end of the spindle, configured to grind the wafer held on the holding table by rotating the grinding wheel in the same direction as the predetermined direction while in contact with the wafer held on the holding table, a grinding feed unit configured to grinding-feed the grinding unit in vertical directions, and a reciprocable unit configured to linearly move the holding table toward and away from the grinding unit. The grinding wheel includes a plurality of grinding stone groups arranged in an annular array, each of the grinding stone groups including at least three grinding stone segments having different thicknesses which include a smallest thickness, an intermediate thickness, and a largest thickness. The grinding stone segments in each of the grinding stone groups are successively arranged in the order of the grinding stone segment having the smallest thickness, the grinding stone segment having the intermediate thickness, and the grinding stone segment having the largest thickness, with uniform gaps left therebetween, and the grinding stone segments in the grinding stone groups have respective radially inner edges aligned with each other in an annular shape. The reciprocable unit positions the center of the wafer held on the holding table at a grinding position where the grinding stone segments pass, and when the grinding wheel is rotated, the grinding stone segments in each of the grinding stone groups, successively in the order of the grinding stone segment having the smallest thickness, the grinding stone segment having the intermediate thickness, and the grinding stone segment having the largest thickness, enter a grinding area on the wafer held on the holding table from an outer circumferential edge of the wafer.

With the above arrangements, the grinding stone segments having the different thicknesses in each of the grinding stone groups are arrayed in the order of the grinding stone segment having the smallest thickness, the grinding stone segment having the intermediate thickness, and the grinding stone segment having the largest thickness with their radially inner edges aligned in an annular shape. When the grinding wheel grinds the surface of the wafer W, the grinding stone segment having the smallest thickness that is easiest to bite into the surface of the wafer W initially grinds a region of the surface of the wafer, and then the grinding stone segment having the intermediate thickness and the grinding stone segment having the largest thickness successively grind the region of the surface of the wafer that has been ground by the grinding stone segment having the smallest thickness. As a consequence, the grinding stone segments have a better ability to bite into the surface of the wafer in the grinding process than grinding stone segments having the same thicknesses.

According to the present invention, the ability of the grinding wheel to bite into the surface of the wafer is improved.

The above and other objects, features and advantages of the present invention and the manner of realizing them will become more apparent, and the invention itself will best be understood from a study of the following description and appended claims with reference to the attached drawings showing a preferred embodiment of the invention.

DETAILED DESCRIPTION OF THE PREFERRED EMBODIMENT

A grinding apparatus according to an embodiment of the present invention will be described in detail below with reference to the accompanying drawings. FIG. depicts in perspective the grinding apparatus according to the present embodiment. The grinding apparatus is not limited to the design depicted in FIG. 1 that is dedicated to grinding operation only, but may be incorporated in a fully automatic wafer processing system where a succession of processes including a grinding process, a polishing process, a cleaning process, and so on are automatically performed on wafers.

Figure 1:
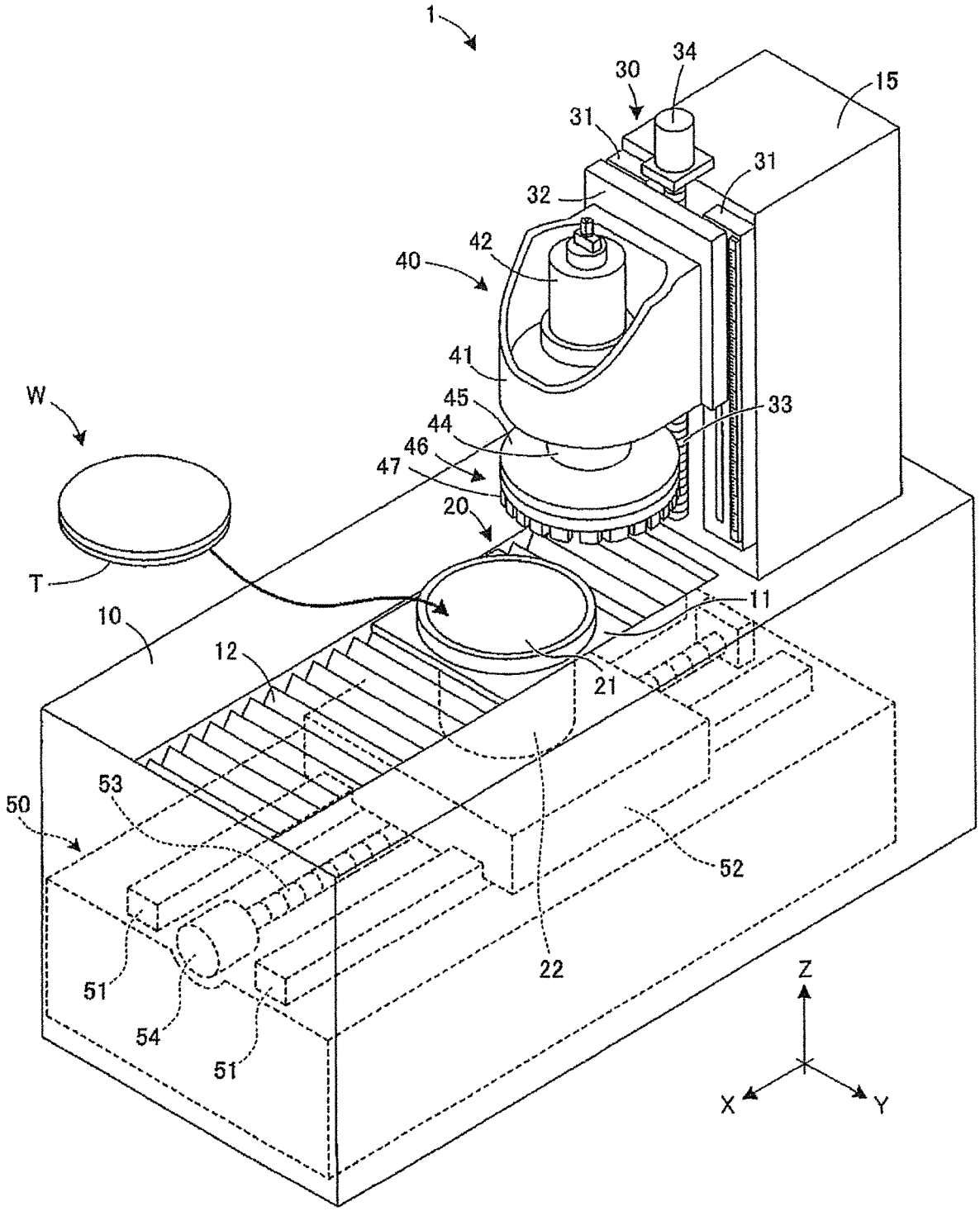
FIG. 1 is a perspective view of a grinding apparatus according to an embodiment of the present invention.

As depicted in FIG. 1, the grinding apparatus, generally denoted by 1, includes a grinding wheel 46 having an annular array of grinding stone segments 47 on a lower surface thereof for grinding a wafer W held on a chuck table 20 as a holding table. The wafer W with a protective tape T stuck to a lower surface thereof is introduced into the grinding apparatus 1 and held on a holding surface 21 of the chuck table 20. The wafer W may be in the form of a plate-like workpiece to be ground, such as a semiconductor wafer made of silicon, gallium arsenide, or the like, an optical device wafer made of ceramics, glass, sapphire, or the like, or an as sliced wafer prior to the formation of a device pattern thereon.

The grinding apparatus 1 includes a base 10 with a rectangular opening defined in an upper surface thereof and extending along an X-axis indicated by the arrow X. The opening is covered with a movable plate 11 that is movable with the chuck table 20 and a bellows-like water-resistant cover 12. The water-resistant cover 12 is disposed over a ball-screw-type reciprocable unit 50 that is housed in the base 10 for linearly moving the chuck table 20 selectively in the directions along the X-axis toward and away from the grinding unit 40. The reciprocable unit 50 serves as positioning means for relatively moving the chuck table 20 and a grinding unit 40, to be described later, in directions parallel to the holding surface 21, for positioning the center of the wafer W held on the chuck table 20 at a grinding position where the grinding stone segments 47 pass.

The reciprocable unit 50 includes a pair of guide rails 51 housed in the base 10 that extend parallel to the X-axis and a motor-driven X-axis table 52 slidably mounted on the guide rails 51. The X-axis table 52 has a nut, not depicted, mounted on a lower surface thereof and threaded over a ball screw 53 disposed between and extending parallel to the guide rails 51. The ball screw 53 has an end coupled to a drive motor 54 which, when energized, rotates the ball screw 53 about its own axis to move the X-axis table 52 in the directions along the X-axis along the guide rails 51.

A table rotating unit 22 is mounted on the X-axis table 52 of the reciprocable unit 50. The chuck table 20 is coupled to an upper side of the table rotating unit 22. The table rotating unit 22 is connected to a rotary actuator mechanism, not depicted, providing a holding table rotating unit for rotating the chuck table 20 about its own axis in a predetermined direction. The chuck table 20 is rotatable about its own axis that is aligned with the center of the wafer W on the chuck table 20 by the table rotating unit 22.

The holding surface 21 of the chuck table 20, which is provided as an upper surface thereof, is made of a porous material and holds the wafer W under suction thereon. The chuck table 20 has a fluid communication channel, not depicted, defined therein that is connected to a suction source, not depicted. The fluid communication channel in the chuck table 20 is held in fluid communication with the holding surface 21. Therefore, when the suction source is actuated, it develops a negative pressure that acts through the fluid communication channel on the holding surface 21, holding the wafer W under suction on the holding surface 21. The holding surface 21 is shaped as an upwardly projecting conical surface that is progressively inclined slightly downwardly toward the outer circumferential edge thereof from a central apex at the center of rotation of the chuck table 20, i.e., the center of the holding surface 21. When the wafer W is held under suction on the upwardly projecting conical surface as the holding surface 21, the wafer W is elastically deformed into an upwardly projecting conical shape complementary to the upwardly projecting conical shape of the holding surface 21.

The grinding apparatus 1 also includes a column 15 mounted on the base 10 adjacent to an end of the opening that is covered with the movable plate 11 and the water-resistant cover 12. The column 15 supports thereon a grinding feed unit 30 for grinding-feeding the grinding unit 40 in directions toward and away from the chuck table 20 or more specifically the holding surface 21, i.e., along a Z-axis indicated by the arrow Z or in vertical directions. The grinding feed unit 30 includes a pair of guide rails 31 mounted on the column 15 that extend parallel to the Z-axis and a motor-driven Z-axis table 32 slidably mounted on the guide rails 31. The Z-axis table 32 has a nut, not depicted, mounted on a rear surface thereof and threaded over a ball screw 33 disposed between and extending parallel to the guide rails 31. The ball screw 33 has an end coupled to a drive motor 34 which, when energized, rotates the ball screw 33 about its own axis to move the Z-axis table 32 in the directions along the Z-axis along the guide rails 31.

The grinding unit 40 is mounted on a front surface of the Z-axis table 32 by a housing 41, and includes a spindle unit 42 for rotating the grinding wheel 46 about its own central axis. The spindle unit 42 has an air spindle structure in which a spindle 44 is rotatably supported by high-pressure air in a casing. The spindle unit 42 rotates the grinding wheel 46 through the spindle 44 in the same direction as the direction in which the chuck table 20 rotates about its own axis.

A mount 45 is coupled to a lower end of the spindle 44, and the grinding wheel 46 with the annular array of grinding stone segments 47 mounted thereon is disposed on a lower surface of the mount 45. Each of the grinding stone segments 47 is made of abrasive grains of diamond having a predetermined diameter and bound together by a vitrified bond, for example. Alternatively, each of the grinding stone segments 47 may be made of abrasive grains of diamond bound together by a binder such as a metal bond, a resin bond, or the like. As described in detail later, the grinding stone segments 47 mounted on the grinding wheel 46 include three types of grinding stone segments that have different thicknesses in radial directions.

Figure 2:
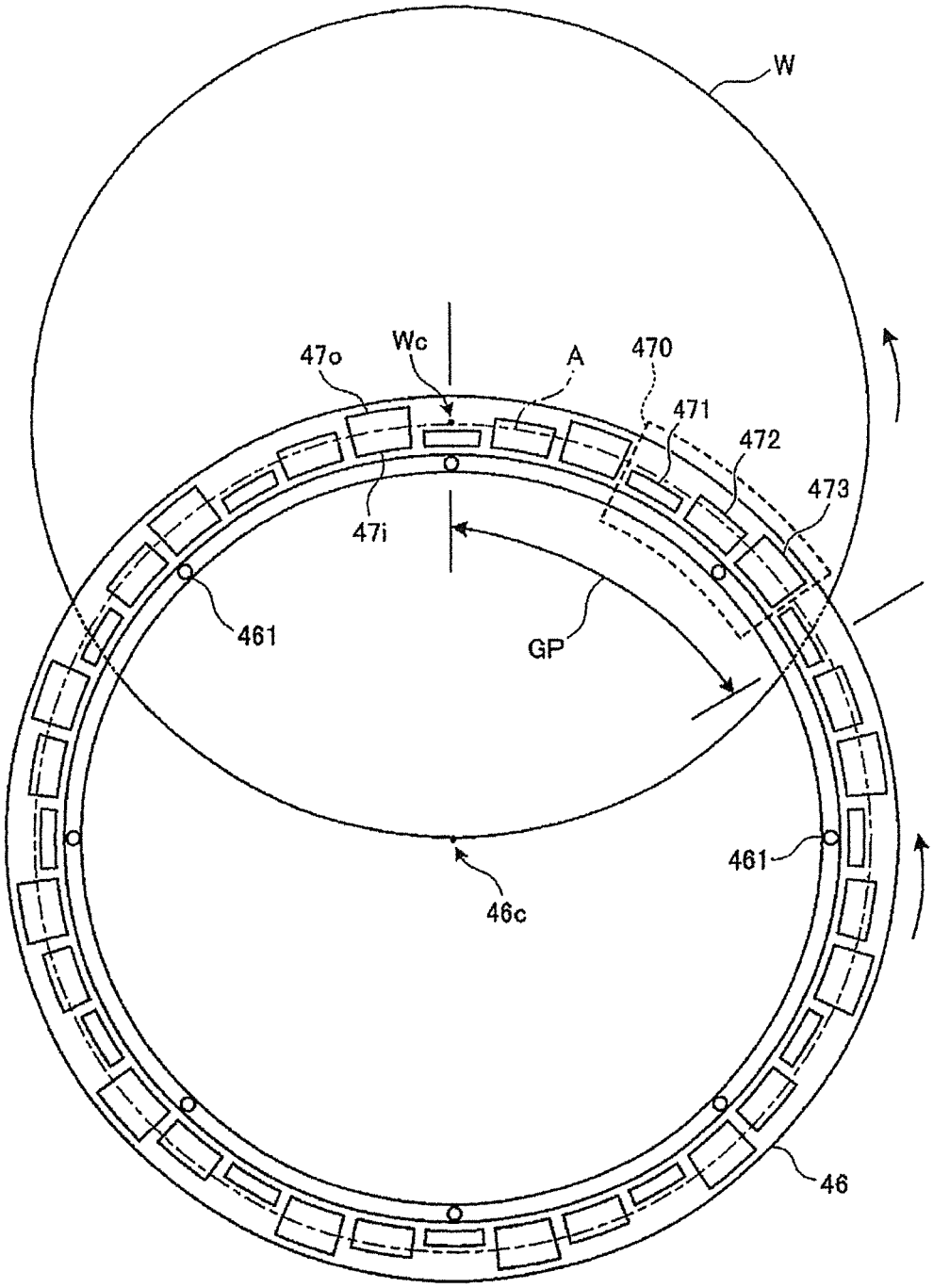
FIG. 2 is a schematic plan view depicting the relation between a grinding wheel of the grinding apparatus according to the embodiment and a wafer to be ground thereby.

Structural details of the grinding wheel 46 according to the present embodiment and the relation between the grinding wheel 46 and the wafer W will be described below with reference to FIG. 2. FIG. 2 is a schematic plan view depicting the relation between the grinding wheel 46 of the grinding apparatus 1 according to the embodiment and the wafer W to be ground thereby. FIG. 2 illustrates the wafer W held on the chuck table 20, which has a center We at a position where the grinding stone segments 47 pass.

According to the present embodiment, the chuck table 20 and the grinding wheel 46 rotate about their own axes in one direction, i.e., counterclockwise in FIG. 2. The chuck table 20 and the grinding wheel 46 may rotate at respective desired rotational speeds insofar as the rotational speed of the grinding wheel 46 is higher than the rotational speed of the chuck table 20.

As depicted in FIG. 2, the grinding stone segments 47 on the grinding wheel 46 includes three types of grinding stone segments 471, 472, and 473 that have different thicknesses in radial directions. The grinding stone segments 471 have a smallest thickness, whereas the grinding stone segments 473 have a largest thickness. The grinding stone segments 472 have an intermediate thickness between the smallest and largest thicknesses of the grinding stone segments 471 and 473. For example, the grinding stone segments 471, 472, and 473 have respective thicknesses of 2 mm, 3 mm, and 4 mm in the radial directions of the grinding wheel 46, though the thicknesses of the grinding stone segments 471, 472, and 473 are not limited those numerical values, but may be of other values.

The grinding stone segments 471, 472, and 473 are arranged in an annular array of grinding stone groups 470, and the grinding stone segments 471, 472, and 473 in each of the grinding stone groups 470 are arrayed successively in the order named, i.e., respectively in a front position, a middle position, and a rear position along the direction in which the grinding wheel 46 rotates. The grinding stone segments 471, 472, and 473 in all the groups have radially inner edges aligned in an annular shape. The grinding stone groups 470 of the grinding stone segments 471, 472, and 473 are arranged in an annular array circumferentially on and along the grinding wheel 46. The grinding stone segment 473 in each of the grinding stone groups 470 is followed by the grinding stone segment 471 in the next adjacent grinding stone group 470 along the direction in which the grinding wheel 46 rotates. Adjacent ones of the grinding stone segments 47, i.e., the grinding stone segments 471, 472, and 473, are spaced from each other by a uniform gap. In other words, the grinding stone segments 47 are arranged in an annular array in the circumferential directions of the grinding wheel 46 with uniform gaps left therebetween.

The reciprocable unit 50 positions the center We of the wafer W held on the chuck table 20 in an annular area, i.e., an annular strip area, that lies radially from radially inner edges 47*i* of the grinding stone segments 47, or more specifically the radially inner edges of the grinding stone segments 471, 472, and 473, to radially outer edges 47*o* of the grinding stone segments 47, or more specifically the radially outer edges of the grinding stone segments 473. At this time, the center Wc of the wafer W is placed on a circle indicated by the dot-and-dash line A in FIG. 2, which extends radially intermediate between the radially inner edges 47*i* of the grinding stone segments 47 and the radially outer edges 47*o* of the grinding stone segments 47. The grinding wheel 46 has a center 46*c* disposed at a position on the outer circumferential edge of the wafer W.

As described above, when the wafer W is held under suction on the holding surface 21, the wafer W is elastically deformed into an upwardly projecting conical shape that is slightly inclined which is complementary to the upwardly projecting conical shape of the holding surface 21. Therefore, the grinding wheel 46 grinds the wafer W in a grinding area GP that is formed in a region of the wafer W which extends from the outer circumferential edge of the wafer W to the center Wc thereof on an orbit in which the grinding stone segments 47 rotate. The grinding wheel 46 has a plurality of grinding water supply ports 461 defined therein radially inwardly of the grinding stone segments 47 at predetermined intervals. While the grinding wheel 46 is grinding the wafer W, the grinding water supply ports 461 supply grinding water to the wafer W.

When the grinding apparatus 1 according to the present embodiment is in operation, the grinding wheel 46 rotates about its own axis, moving the grinding stone segments 47 successively into the grinding area GP from the outer circumferential edge of the wafer W thereby to grind the upper surface of the wafer W. At this time, the grinding stone segments 471, 472, and 473 in each grinding stone group 470 successively enter the grinding area GP, so that the grinding stone segments 47 as they come into contact with the wafer W become progressively larger in radial thickness.

If a conventional grinding wheel with grinding stone segments having the same radial thicknesses grinds a wafer, then since the areas of the wafer that are ground by the grinding stone segments are the same as each other, the grinding stones may possibly fail to exhibit a sufficient ability to bite into the surface being ground of the wafer. Particularly, the problem of an insufficient biting ability is liable to occur when those grinding stones are used to grind wafers made of a hard material such as SiC or sapphire or the grinding wheel rotates at high rotational speeds, i.e., when the grinding wheel grinds wafers under strict grinding conditions.

The inventor of the present invention has paid attention to the fact that grinding stone segments having the same radial thicknesses may possibly have an insufficient biting ability under certain grinding conditions in grinding processes, and has found out that grinding stone segments having different radial thicknesses tend to have an improved biting ability in grinding processes where the grinding stones as they come into contact with a wafer become progressively larger in radial thickness. As a result, the inventor has achieved the present invention based on the above finding.

The essential features of the present invention reside in the fact that the grinding stone segments 47 arranged in an annular pattern on the grinding wheel 46 for grinding the wafer W include three types of grinding stone segments 471, 472, and 473 having different radial thicknesses in the grinding stone groups 470, and the grinding stone segments 471, 472, and 473 in each of the grinding stone groups 470 are arrayed in the order of the grinding stone segment 471 having the smallest radial thickness, the grinding stone segment 472 having the intermediate radial thickness, and the grinding stone segment 473 having the largest radial thickness with their radially inner edges aligned in an annular shape. When the grinding wheel 46 grinds the surface of the wafer W, the grinding stone segment 471 having the smallest radial thickness that is easiest to bite into the surface of the wafer W initially grinds the surface of the wafer W, and then the grinding stone segment 472 having the intermediate radial thickness and the grinding stone segment 473 having the largest radial thickness successively grind the surface of the wafer W that has been ground by the grinding stone segment 471. As a consequence, the grinding stone segments 47 have a better ability to bite into the surface of the wafer W in the grinding process than grinding stone segments having the same radial thicknesses.

The state of the surface of the wafer W that is ground in a grinding process carried out by the grinding apparatus 1 according to the present embodiment will be described below with reference to FIGS. 3 through 6. FIGS. 3 through 6 are enlarged fragmentary plan views illustrating the relation between the surface of the wafer W that is ground by the grinding apparatus 1 according to the embodiment and the grinding stone segments 471, 472, and 473. In FIGS. 3 through 6, the grinding area GP of the wafer W and its peripheral area are illustrated at an enlarged scale, and only the grinding stone segments 471, 472, and 473 in one grinding stone group 470 are depicted for illustrated purposes.

Figure 3:
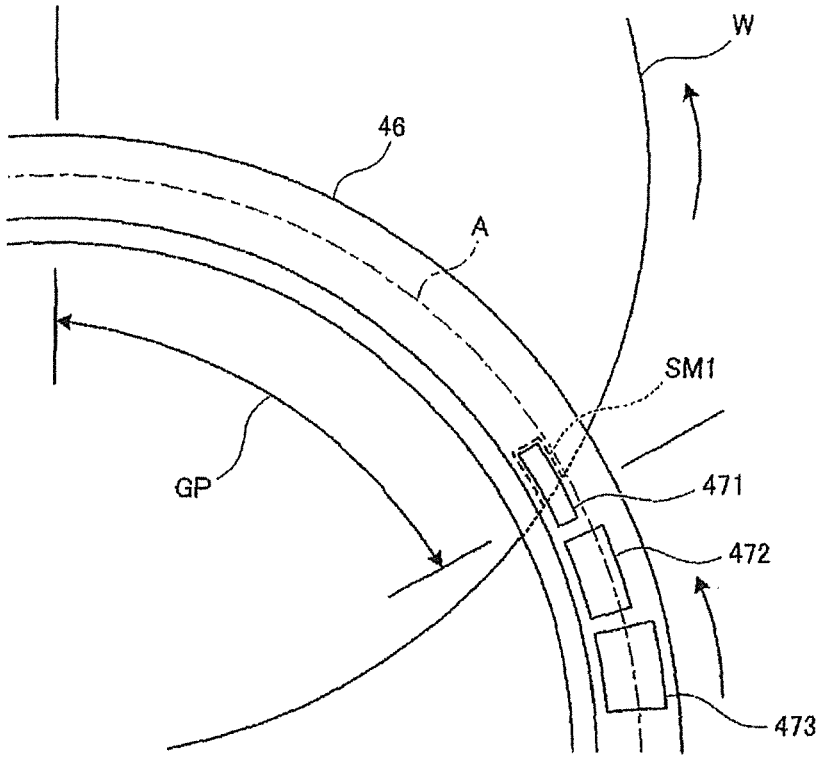
FIG. 3 is an enlarged fragmentary plan view of the surface of the wafer that is ground by the grinding apparatus according to the embodiment.

FIG. 3 illustrates the state of the surface of the wafer W that is ground immediately after the grinding stone segment 471 has entered the grinding area GP. When the grinding stone segment 471 enters the grinding area GP from the outer circumferential edge of the wafer W, the surface of the wafer W is ground in a region depending on the radial thickness of the grinding stone segment 471. At this time, since the radial thickness of the grinding stone segment 471 is small, the grinding stone segment 471 is easy to bite into the surface of the wafer W, and can grind the surface of the wafer W with a good biting ability. In FIGS. 3 through 6, a ground mark SM1 that is left on the surface of the wafer W by the grinding stone segment 471 is indicated by the broken line.

Figure 4:
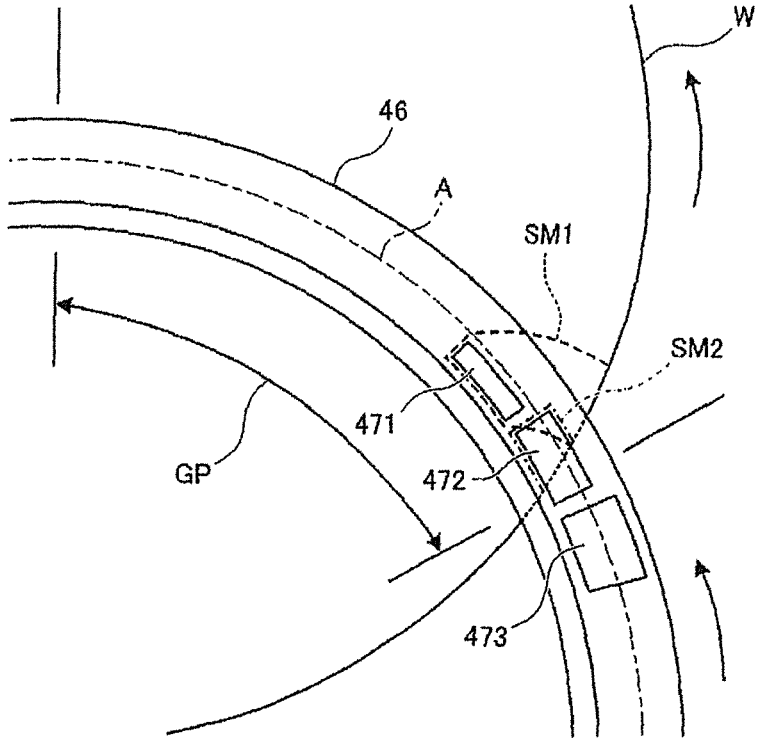
FIG. 4 is an enlarged fragmentary plan view of the surface of the wafer that is ground by the grinding apparatus according to the embodiment.
Figure 5:
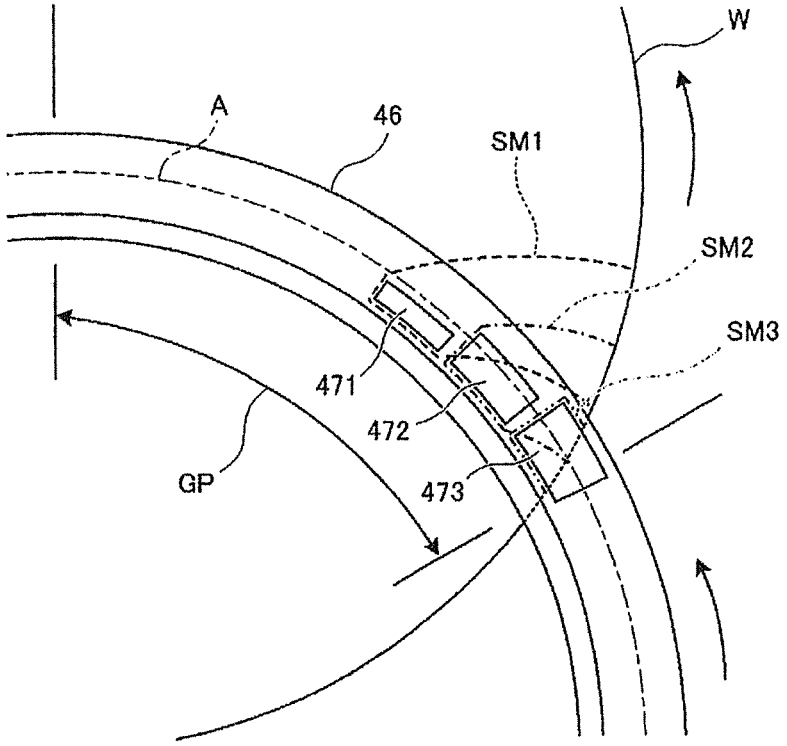
FIG. 5 is an enlarged fragmentary plan view of the surface of the wafer that is ground by the grinding apparatus according to the embodiment.
Figure 6:
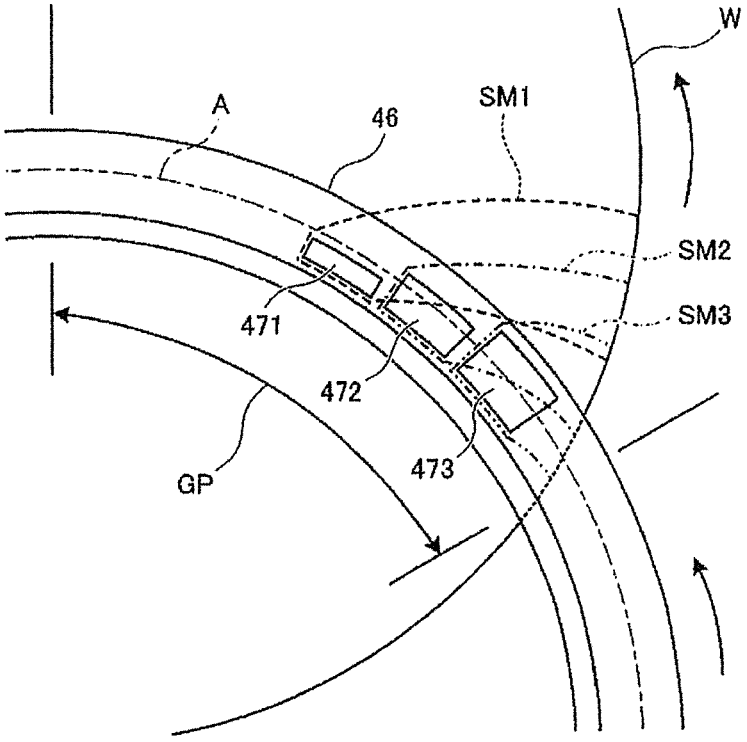
FIG. 6 is an enlarged fragmentary plan view of the surface of the wafer that is ground by the grinding apparatus according to the embodiment.

As the wafer W and the grinding wheel 46 rotate from the state depicted in FIG. 3, the grinding stone segment 472 that follows the grinding stone segment 471 enters the grinding area GP. FIG. 4 illustrates the state of the surface of the wafer W that is ground immediately after the grinding stone segment 472 has entered the grinding area GP. When the grinding stone segment 472 enters the grinding area GP from the outer circumferential edge of the wafer W, the grinding stone segment 472 grinds a region of the surface of the wafer W depending on the radial thickness of the grinding stone segment 472. In FIGS. 4 through 6, a ground mark SM2 that is left on the surface of the wafer W by the grinding stone segment 472 is indicated by the dot-and-dash line.

At this time, the ground mark SM1 left by the grinding stone segment 471 has spread from the present position of the grinding stone segment 471 toward the outer circumferential edge of the wafer W, as depicted in FIG. 4. The ground mark SM1 is thus spread because the wafer W and the grinding wheel 46 rotate at the same time.

The grinding stone segment 472 that has entered the grinding area GP grinds a region of the surface of the wafer W in overlapping relation to the region ground by the grinding stone segment 471, i.e., the region indicated by the ground mark SM1. At the same time that the grinding stone segment 472 grinds the region ground by the grinding stone segment 471, i.e., the region indicated by the ground mark SM1, the grinding stone segment 472 grinds a region not ground by the grinding stone segment 471, i.e., a region not overlapping the ground mark SM1, following the grinding stone segment 471.

Inasmuch as the rotational speed of the grinding wheel 46 is higher than the rotational speed of the wafer W, the grinding stone segment 472 can grind an increased region of the surface of the wafer W in overlapping relation to the region ground by the grinding stone segment 471, i.e., the region indicated by the ground mark SM1. The higher the rotational speed of the grinding wheel 46 is, or the lower the rotational speed of the chuck table 20 is, the smaller the spreading of the ground mark SM1 becomes, and the smaller the proportion of the region ground by the grinding stone segment 472 to the region indicated by the ground mark SM1 becomes. Therefore, it is easier for the grinding stone segment 472 to bite into the surface of the wafer W, and the rotational speed of the grinding wheel 46 can be made higher.

As the wafer W and the grinding wheel 46 rotate from the state depicted in FIG. 4, the grinding stone segment 473 that follows the grinding stone segment 472 enters the grinding area GP. FIG. 5 illustrates the state of the surface of the wafer W that is ground immediately after the grinding stone segment 473 has entered the grinding area GP. When the grinding stone segment 473 enters the grinding area GP from the outer circumferential edge of the wafer W, it grinds a region of the surface of the wafer W depending on the radial thickness of the grinding stone segment 473. In FIGS. 5 and 6, a ground mark SM3 that is left on the surface of the wafer W by the grinding stone segment 473 is indicated by the two-dot-and-dash line.

At this time, the ground mark SM2 left by the grinding stone segment 472 has spread from the present position of the grinding stone segment 472 toward the outer circumferential edge of the wafer W, as depicted in FIG. 5. The ground mark SM1 left by the grinding stone segment 471 has further spread from the state depicted in FIG. 4 toward the outer circumferential edge of the wafer W.

The grinding stone segment 473 that has entered the grinding area GP grinds a region of the surface of the wafer W in overlapping relation to the region ground by the grinding stone segment 472, i.e., the region indicated by the ground mark SM2, and also grinds a region not ground by the grinding stone segment 472, i.e., a region not overlapping the ground mark SM2, following the grinding stone segment 472.

As the wafer W and the grinding wheel 46 rotate from the state depicted in FIG. 5, the grinding stone segments 471, 472, and 473 move in the grinding area GP forwardly, i.e., downstream, along the direction in which the grinding wheel 46 rotates. FIG. 6 illustrates the state of the surface of the wafer W after the grinding stone segments 471, 472, and 473 have further rotated from the state depicted in FIG. 5. At this time, as depicted in FIG. 6, the grinding stone segment 472 continuously grinds a region overlapping the region ground by the grinding stone segment 471, and the grinding stone segment 473 continuously grinds a region overlapping the regions ground by the grinding stone segments 471 and 472.

As the wafer W and the grinding wheel 46 rotate, the grinding stone segment 471 initially bites into the surface of the wafer W, thereby performing a triggering grinding session. The grinding stone segments 472 and 473 that follow the grinding stone segment 471 then grind the surface of the wafer W while gradually enlarging the region ground by the grinding stone segment 471. In this manner, the grinding wheel 46 can effectively grind the wafer W even if the wafer W is made of a hard material such as SiC or sapphire or the grinding wheel 46 rotates at high rotational speeds, i.e., when the grinding wheel 46 grinds the wafer W under strict grinding conditions.

As described above, the grinding apparatus 1 according to the present embodiment includes the grinding wheel 46 with the grinding stone groups 470 of three types of grinding stone segments 471, 472, and 473 having different radial thicknesses and arranged in an annular array such that the grinding stone segment 471 having the smallest radial thickness, the grinding stone segment 472 having the intermediate radial thickness, and the grinding stone segment 473 having the largest radial thickness are successively arrayed in the order named with their radially inner edges aligned in an annular shape. In the grinding process, the grinding stone segments 471, 472, and 473 in each group successively enter the grinding area GP in the order named from the outer circumferential edge of the wafer W. Specifically, after the grinding stone segment 471 having the smallest radial thickness, which is easiest to bite into the surface of the wafer W, has initially ground a region of the surface of the wafer W, the grinding stone segments 472 and 473 that are larger in radial thickness than the grinding stone segment 471 successively enter the grinding area GP to grind respective regions of the surface of the wafer W. More specifically, the grinding stone segment 472 grinds a region of the surface of the wafer W in overlapping relation to the region of the surface of the wafer W that has been ground by the grinding stone segment 471, and then the grinding stone segment 473 grinds an area of the surface of the wafer W in overlapping relation to the region of the surface of the wafer W that has been ground by the grinding stone segment 472. As a consequence, the grinding wheel 46 has a better ability to bite into the surface of the wafer W than a grinding wheel including grinding stone segments having the same radial thicknesses.

Particularly, the three types of grinding stone segments 471, 472, and 473 having different radial thicknesses are arranged in an annular array with their radially inner edges 47*i* (see FIG. 2) aligned with each other. The aligned radially inner edges 47*i* are effective to increase the region ground by a following grinding stone segment 47, e.g., the grinding stone segment 472, in overlapping relation to the region ground by a preceding grinding stone segment 47, e.g., the grinding stone segment 471. Therefore, the grinding wheel 46 can ground the surface of the wafer W with a better biting ability. Furthermore, after the grinding stone segment 473 having the largest radial thickness in one grinding stone group 470 has entered the grinding area GP, it is followed by the grinding stone segment 471 in the next grinding stone group 470 that enters the grinding area GP from the outer circumferential edge of the wafer W. Since the grinding stone segment 471 has the smallest radial thickness, it tends to be worn greatly though it bites easily into the grinding area GP, with the result that the narrow ground mark SM1 left thereby appears as a defect. The grinding stone segments 472 and 473 that follow the grinding stone segment 471 are worn to a smaller extent as their radial thicknesses are larger, leaving neater ground marks SM2 and SM3. In other words, the surface of the wafer W is finally ground by the grinding stone segments 473 that are worn to the least extent, leaving the same ground mark SM3 as heretofore.

The present invention is not limited to the embodiment described above, but many changes, replacements, and modifications may be made without departing from the scope of the present invention. Furthermore, the present invention may be reduced to practice according to other techniques, processes, schemes, plans, or arrangements insofar as they are capable of implementing the principles of the present invention owing to technological advances or derivations. Therefore, the scope of the appended claims should be interpreted as covering all the embodiments falling within the range of the technical idea of the present invention.

For example, in the above embodiment, the grinding wheel 46 has three types of grinding stone segments 47, i.e., 471, 472, and 473, having different radial thicknesses. However, the grinding stone segments 47 are not limited to three types, i.e., three different radial thicknesses. Rather, the grinding wheel 46 may have four or more types of grinding stone segments 47 having different radial thicknesses, insofar as those grinding stone segments 47 are capable of grinding the surface of the wafer W appropriately.

In the above embodiment, the three types of grinding stone segments 47 have radial inner edges 47*i* aligned with each other in an annular shape. However, the grinding stone segments 47 are not limited to the arrangement where the radial inner edges thereof are aligned with each other. Instead, the grinding stone segments 47 may be arranged in desired positions insofar as they have a required ability to bite into the surface of the wafer W and the region ground by a preceding grinding stone segment 47 is overlappingly ground by a following grinding stone segment 47. For example, the three types of grinding stone segments 47 may have radial outer edges 47*o* aligned with each other in an annular shape. Furthermore, the three grinding stone segments 471, 472, and 473 in each grinding stone group 470 may have their centers in the radial directions of the grinding wheel 46 aligned with each other, or more specifically, aligned with the circle indicated by the dot-and-dash line A in FIG. 2.

The grinding wheel 46 and hence the grinding apparatus 1 may grind various workpieces including, for example, a semiconductor device wafer, an optical device wafer, a package board, a semiconductor board, an inorganic material board, an oxide wafer, a raw ceramics board, and a piezoelectric board, etc. The semiconductor device wafer may include a silicon wafer or a compound semiconductor wafer with devices formed thereon. The optical device wafer may include a sapphire wafer or a silicon carbide wafer with devices formed thereon. The package board may include a chip size package (CSP) board. The semiconductor board may include a board made of silicon, gallium arsenide, or the like. The inorganic material board may include a board made of sapphire, ceramics, glass, or the like. The oxide wafer may include a wafer made of lithium tantalate, lithium niobate, or the like with or without devices thereon.

As described above, the present invention is advantageous in that it can provide an improved ability to bite into the surface of a wafer, and is particularly useful when incorporated in a grinding wheel and a grinding apparatus for grinding the surface of a wafer.

The present invention is not limited to the details of the above described preferred embodiment. The scope of the invention is defined by the appended claims and all changes and modifications as fall within the equivalence of the scope of the claims are therefore to be embraced by the invention.

What is claimed is:

1. A grinding wheel comprising:

a plurality of grinding stone groups arranged in an annular array, each of the grinding stone groups including at least three grinding stone segments having different thicknesses in a radial direction which include a smallest thickness, an intermediate thickness, and a largest thickness;

wherein the grinding stone segments in each of the grinding stone groups are successively arranged in the order of the grinding stone segment having the smallest thickness, the grinding stone segment having the intermediate thickness, and the grinding stone segment having the largest thickness, with uniform gaps left therebetween, and the grinding stone segments in the grinding stone groups have respective radially inner edges aligned with each other in an annular shape.

2. A grinding apparatus comprising:

a holding table having a holding surface for holding a wafer thereon;

a holding table rotating unit configured to rotate the holding table in a predetermined direction;

a grinding unit having a spindle and a grinding wheel mounted on a distal end of the spindle, configured to grind the wafer held on the holding table by rotating the grinding wheel in the same direction as the predetermined direction while in contact with the wafer held on the holding table;

a grinding feed unit configured to grinding-feed the grinding unit in vertical directions; and a reciprocable unit configured to linearly move the holding table toward and away from the grinding unit;

wherein the grinding wheel includes a plurality of grinding stone groups arranged in an annular array, each of the grinding stone groups including at least three grinding stone segments having different thicknesses in a radical direction which include a smallest thickness, an intermediate thickness, and a largest thickness;

the grinding stone segments in each of the grinding stone groups are successively arranged in the order of the grinding stone segment having the smallest thickness, the grinding stone segment having the intermediate thickness, and the grinding stone segment having the largest thickness, with uniform gaps left therebetween, and the grinding stone segments in the grinding stone groups have respective radially inner edges aligned with each other in an annular shape; and the reciprocable unit positions the center of the wafer held on the holding table at a grinding position where the grinding stone segments pass, and when the grinding wheel is rotated, the grinding stone segments in each of the grinding stone groups, successively in the order of the grinding stone segment having the smallest thickness, the grinding stone segment having the intermediate thickness, and the grinding stone segment having the largest thickness, enter a grinding area on the wafer held on the holding table from an outer circumferential edge of the wafer.

* * * * *